United States Patent [19]

Tsai

[11] Patent Number: 4,899,769

[45] Date of Patent: Feb. 13, 1990

[54] PAINT SPRAY-GUN CLEANER

[76] Inventor: Mu-Yuan T. Tsai, No. 111-3, Min-Tsu Rd., Shen-Kang Hsiang, Taichung, Taiwan

[21] Appl. No.: 257,223

[22] Filed: Oct. 13, 1988

[51] Int. Cl.[4] ..... B08B 3/02

[52] U.S. Cl. ..... 134/111; 134/166 R; 134/184; 134/198; 134/200

[58] Field of Search ..... 134/102, 200, 160 R, 134/111, 44, 47, 54, 166 C, 184, 186, 198, 199

[56] References Cited

U.S. PATENT DOCUMENTS

| | | | |
|---|---|---|---|
| 2,682,273 | 6/1954 | Roach | 134/200 X |
| 2,745,418 | 5/1956 | Balcom et al. | 134/102 |
| 4,025,363 | 5/1977 | DeSantis | 134/200 X |
| 4,676,261 | 6/1987 | Blaul | 134/200 |

*Primary Examiner*—Frankie L. Stinson

*Attorney, Agent, or Firm*—Burns, Doane, Swecker & Mathis

[57] ABSTRACT

A paint spray-gun cleaner includes a tank having an upper chamber for receiving the paint spray-gun to be cleaned, and a lower chamber for containing a cleaning solvent. The solvent is forced to flow from the lower chamber to the nozzles in the upper chamber by a solvent pumping unit. Compressed air is intermittently supplied to the solvent pumping unit so as to force the solvent out of the solvent pumping unit. When a cover is placed on the top of the tank to seal the upper chamber, the poppet valve of a switch is opened, thereby permitting compressed air to pass through the switch to the solvent pumping unit. When the cover is opened, the switch is closed and the flow of compressed air into the solvent pumping unit is thus stopped.

2 Claims, 4 Drawing Sheets

PAINT SPRAY-GUN CLEANER

BACKGROUND OF THE INVENTION

This invention relates to a cleaner, more particularly to a paint spray-gun cleaner.

After a paint spray-gun has been used, it is usually cleaned with a solvent, such as methanol or methyl ethanone. However, it is easy for these combustible and harmful solvents to damage the skin of the user during the cleaning of a paint spray-gun.

SUMMARY OF THE INVENTION

The main object of this invention is therefore to provide a paint spray-gun cleaner which can clean a paint spray-gun without requiring the user to come into contact with harmful cleaning solvents.

Another object of this invention is to provide a safe paint spray-gun cleaner which can prevent combustion of the solvents used in the cleaning process.

According to this invention, a paint spray-gun cleaner includes a tank in which a partition is fixed for dividing the inside of the tank into an upper chamber and a lower chamber. A cover is mounted movably on the top of the tank for sealing the upper chamber. A drainage valve is disposed at the lower end of the tank. The upper chamber is used to receive the paint spray-gun to be cleaned, while the lower chamber is used to contain the cleaning solvents. The drainage valve can be opened to discharge the solvent from the tank. A plurality of nozzles are installed in the periphery of the upper chamber so as to direct the solvent from the lower chamber to the spray-gun. The solvent from the lower chamber is forced into the nozzles by a solvent pumping unit. A filter is installed in the lower chamber so as to remove solids from the solvent when the solvent flows from the lower chamber to the solvent pumping unit. A compressed air source is connected to the solvent pumping unit. A switch is installed in the upper chamber and interconnects the compressed air source and the solvent pumping unit. When the cover is closed to engage with the switch, the poppet valve of the switch is opened to allow air flow between the compressed air source and the solvent pumping unit. When the cover is opened, the poppet valve of the switch is closed so that air flow between the compressed air source and the solvent pumping unit is stopped.

Accordingly, when the cover is closed and compressed air is supplied to the switch, the solvent pumping unit forces the solvent from the lower chamber to the nozzles which in turn spray the solvent onto the spray-gun.

Preferably, the cover is hinged to the tank at one side thereof and connected to the tank by a knuckle joint at the free end of the cover. The knuckle joint is welded to the tank so that when the environmental temperature is high enough to melt the solder between the cover and the tank, the cover is closed. Disaster due to fire is therefore prevented.

BRIEF DESCRIPTION OF THE DRAWINGS

Other features and advantages of this invention will become apparent in the following detailed description of a preferred embodiment of this invention, with reference to the accompanying drawings, in which.

DETAILED DESCRIPTION OF THE PREFERRED EMBODIMENT

Figure 1:
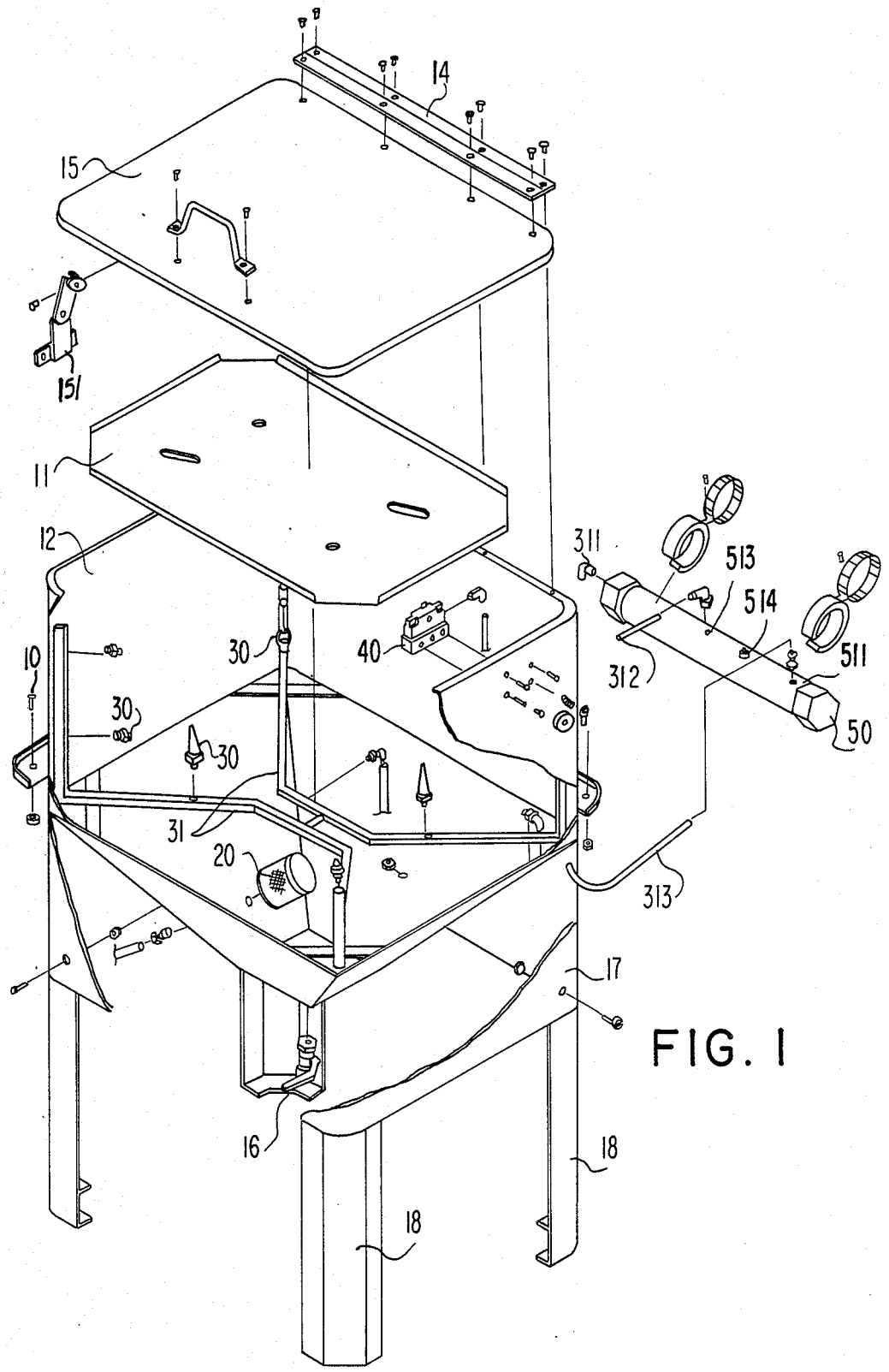
FIG. 1 is an exploded view of a paint spray-gun cleaner according to this invention, in which the side wall of a tank is partially cut away for clarity.

Referring to FIG. 1, a paint spray-gun cleaner of this invention includes a tank 10, a filter 20, a plurality of nozzles 30, a switch 40 and a solvent pumping unit 50.

The inside of the tank 10 is divided into an upper chamber 12 and a funnel-like lower chamber 13 by a partition 11. A cover 15 is mounted rotatably on the top of the tank 10 by a hinge 14 at one side thereof. The free end of the cover 15 is connected movably to the tank 10 by a knuckle joint 151. The knuckle joint 151 is screwed to the cover 15 and welded to the top of the tank 10. The upper chamber 12 is used to receive therein the paint spray-gun to be cleaned, while the lower chamber 12 is used to contain therein a cleaning solvent, such as methanol or methyl ethanone. The spray-gun and the solvent are not shown in this diagram. The tank 10 includes a drainage valve 16 provided at the lower end thereof for the drainage of the solvent. A frame 17 supports the tank 10 thereon and has four legs 18.

The filter 20 is installed in the lower chamber 13. When the solvent flows from the lower chamber 13 to the nozzles 30, solids are removed from the solvent by the filter 20.

The nozzles 30 are installed in the periphery of the upper chamber 12 and intercommunicated by a piping 31 so as to direct the solvent to the spray-gun.

Figure 2:
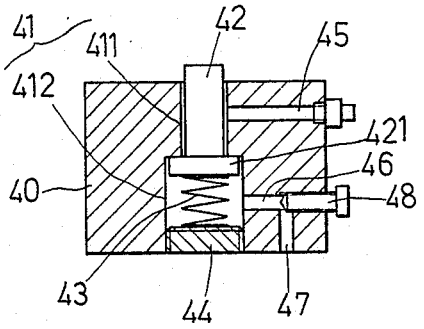
FIGS. 2 and 3 are schematic sectional views illustrating the operation of the switch of the cleaner according to this invention.

The switch 40 is installed in the top of the upper chamber 12. Referring to FIG. 2, the switch 40 has a central passage 41 which has a small-diameter upper section 411 and a large-diameter lower section 412. The lower end of the central passage 41 is closed by a seal 44. A poppet valve 42 is provided within the central passage 41. A spring 43 is disposed between the head 421 of the poppet valve 43 and the seal 44. An exhaust passage 45 is communicated with the smalldiameter section 411 of the central passage 41 while an intake passage 46, 47 is communicated with the largediameter section 412 of the central passage 41. A compressed air source (not shown) supplies compressed air into the switch 40 through the intake passage 46, 47. The intake passage 46, 47 is equipped with a flow control valve 48. When the cover 15 is opened, the poppet valve 42 stops air flow between the intake passage 46, 47 and the exhaust passage 45. Compressed air is intermittently supplied to the switch 40 by the timing control of a controller (not shown).

Figure 3:
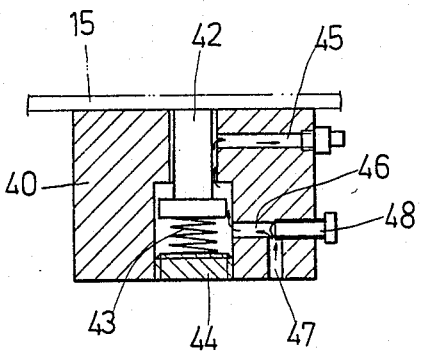

Referring to FIG. 3, when the cover 15, indicated by the phantom lines, is closed to depress the poppet valve 42, compressed air flows from the intake passage 46, 47 to the exhaust passage 45.

Figure 4:
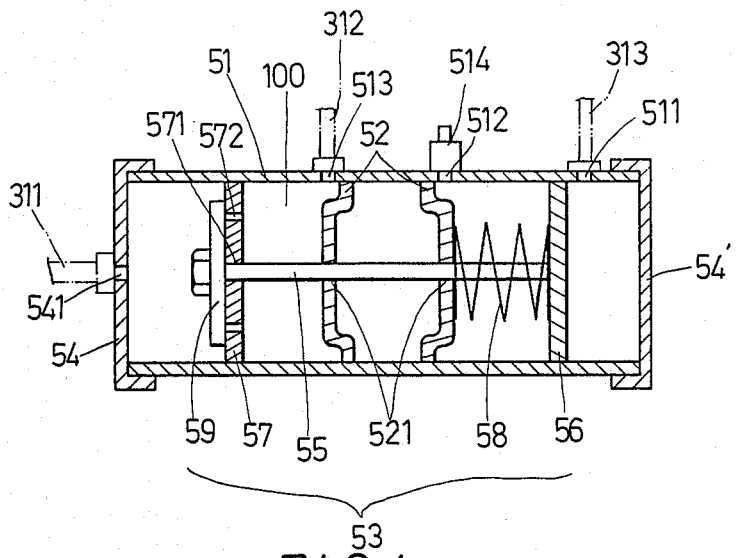
FIGS. 4 and 5 are schematic sectional views illustrating the operation of the solvent pumping unit of the cleaner according to this invention.

The solvent pumping unit 50 is disposed below the tank 10. Referring to FIG. 4, the solvent pumping unit 50 includes a circular tube 51, two bafflers 52, a piston assembly 53 and two caps 54, 54'. The caps 54, 54' respectively seal the two ends of the tube 51. The wall of the tube 51 has an air inlet 511, an air outlet 512 and a solvent outlet 513. The bafflers 52, each having a central hole, are separately fixed in the tube 51 and positioned between the air outlet 512 and the solvent outlet 513. The piston assembly 53 includes a piston rod 55, a piston 56, a solvent pressing ring 57, a compression spring 58 and a circular sealing disk 59. The piston rod 55 extends through the central holes 521 of the bafflers 52. A liquid-tight and air-tight seal is achieved between the piston rod 55 and each of the bafflers 52 by a packing (not shown). The piston 56 and the ring 57 are made of Teflon and have an outer diameter which is slightly smaller than the inner diameter of the circular tube 51. The piston 56 is secured to the right end of the piston rod 55 and can move between the air inlet 511 and the air outlet 512. The ring 57 can move between the solvent outlet 513 and the solvent inlet 541 of the left cap 54. The ring 57 has a central hole 571 through which the piston rod 55 extends, and several annularly positioned solvent passages 572 formed through the ring 57. The spring 58 is sleeved on the piston rod 55 between the piston 56 and the right baffler 52. The disk 59 is screwed to the left end of the piston rod 55. The disk 59 is sized so that when said disk 59 abuts against the ring 57, said disk 59 seals all of the solvent passages 572.

Figure 6:
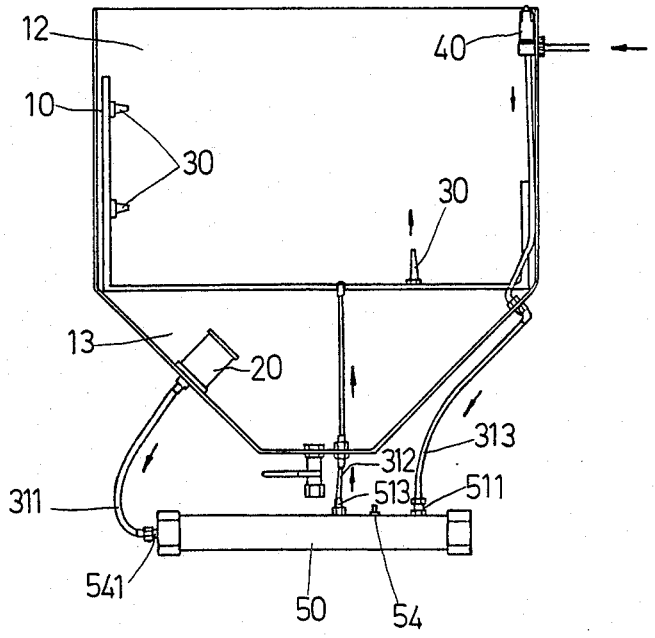
FIG. 6 is a schematic view illustrating the arrangement of the piping of the cleaner according to this invention.

Referring to FIGS. 1 and 6, the solvent inlet 541 of the solvent pumping unit 50 is communicated with the filter 20 by a first pipe 311 so that the solvent can flow from the lower chamber 13 to the solvent pumping unit 50. The solvent outlet 513 of the solvent pumping unit 50 is communicated with the piping 31 in the upper chamber 12 by a second pipe 312 so that the solvent from the lower chamber 13 of the tank. 10 can be supplied to the nozzles 30. The air inlet 511 of the solvent pumping unit 50 is communicated with the exhaust passage 45 of the switch 40 by a third pipe 313 so that compressed air can be supplied into the solvent pumping unit 50. The solvent pumping unit 50 is equipped with a muffler 514 near the air outlet 512 so as to minimize the exhaust noise from the air outlet 512.

In operation, an appropriate amount of solvent is placed into the lower chamber 13 of the tank 10 while a paint spray-gun is placed into the upper chamber 12 of the tank 10. The solvent will flow into the solvent pumping unit 50 through the filter 20 and the first pipe 311. The flow control valve 48 of the switch 40 is adjusted. When the cover 15 is closed thereby opening the switch 40, compressed air is permitted to flow from the compressed air source into the solvent pumping unit 50 through the switch 40 and the pipe 313.

Figure 5:
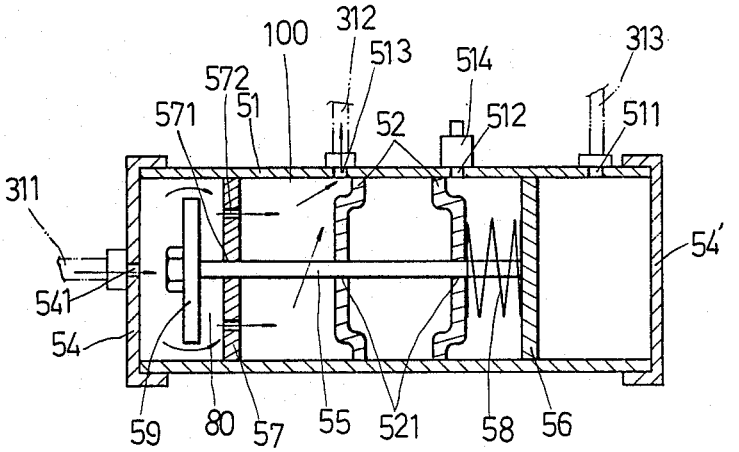

Referring to FIG. 5, when compressed air flows into the solvent pumping unit 50 through the air inlet 511 to move the piston assembly to the left, the ring 57 moves at a speed slower than that of the ring 59 due to the fact that slight friction occurs between the circular tube 51 and the ring 57, thereby forming a space 80 between the ring 57 and the disk 59. As a result, the solvent flows into the chamber 100 between the left baffler 52 and the ring 57 through the solvent passages 572 of the ring 57.

Compressed air is intermittently supplied to the solvent pumping unit 50, as described. When compressed air is no longer supplied into the solvent pumping unit 50, the piston assembly moves to the right by the action of the spring 58. During the movement of the piston assembly to the right, the disk 59 initially moves to abut against the ring 57 so as to seal the solvent passages 572 of the ring 57. Then, the disk 59 impels the ring 57 to the right so as to extrude the solvent which is in the chamber 100 between the ring 57 and the left baffler 52 from the solvent pumping unit 50 through the second pipe 312 and the piping 31 to the nozzles 30. As illustrated, due to the holes formed in the partition 11, the solvent from the nozzles 30 can return to the lower chamber 13.

As a safety precaution for the user of this invention, again referring to FIG. 1, the free end of the cover 15 is connected movably to the top of the tank 10 by the knuckle joint 151 which is welded to the tank 10, as described hereinbefore. When the environmental temperature is high enough to melt the solder between the cover 15 and the tank 10, the cover 15 closes so as to prevent the solvent in the tank 10 from burning. Disaster due to fire can therefore be prevented.

With this invention thus explained, it is apparent that numerous modifications and variations can be made without departing from the scope and spirit of this invention. It is therefore intended that this invention be limited only as indicated in the appended claims.

I claim:

1. A paint spray-gun cleaner comprising:

a tank including a partition fixed therein for dividing the inside of said tank into an upper chamber and a lower chamber, a cover mounted movably on top of said tank for sealing said upper chamber, and a drainage valve disposed at a lower end of said tank, said upper chamber being capable of receiving therein a paint spray-gun to be cleaned while said lower chamber being capable of containing therein a cleaning solvent, said drainage valve being openable to discharge the solvent from said tank;

a plurality of nozzles installed in the periphery of said upper chamber so as to direct said solvent from said lower chamber to said spray-gun;

a solvent pumping unit for forcing said solvent from said lower chamber to said nozzles wherein said solvent pumping unit comprises:

a circular tube having an air inlet, an air outlet and a solvent outlet all of which are formed in a wall of said tube;

two bafflers fixed separately in said circular tube between said air outlet and said solvent outlet for dividing the inside of said circular tube into three compartments;

a piston rod extending movably through the centers of said bafflers;

a piston secured to one end of said piston rod and movable between said air inlet and said air outlet;

a compression spring sleeved on said piston rod between said piston and said bafflers for biasing said piston to move away from said bafflers;

a circular sealing disk secured to the other end of said piston rod at its center;

two caps respectively sealing two ends of said circular tube, one of said caps near said disk having a solvent inlet formed therethrough; and a solvent pressing ring, sleeved movably on said piston rod between said ring and said bafflers, frictionally fitted and movable in said circular tube between said solvent inlet and said solvent outlet, having a center hole and at least one solvent passage formed therethrough, said solvent passage being sealed by said disk when said ring engages with said disk;

whereby, when compressed air enters said pumping unit through said air inlet, said disk is moved away from said ring to open said solvent passage so that said solvent can flow into a chamber between said ring and said bafflers; and when compressed air is no longer fed into said circular tube, said disk moves toward said ring to impel said ring to in turn extrude said solvent from said pumping unit;

a filter installed in said lower chamber for removing solids from said solvent when said solvent flows from said lower chamber to said solvent pumping unit; and a switch, installed on the top of said tank, actuatable by said cover to allow compressed air to flow into said solvent pumping unit, capable of stopping the flow of compressed air into said solvent pumping unit when said cover is opened;

whereby, when said cover is closed and compressed air is supplied to said switch, said solvent pumping unit forces said solvent from said lower chamber to said nozzles to in turn spray said solvent onto said spray-gun.

2. A paint spray-gun cleaner as claimed in claim 1, wherein said switch includes:

a switch body having an intake passage formed therein, and an exhaust passage formed in said switch body and communicated with said intake passage; and a spring-loaded poppet valve, disposed between said intake and exhaust passages for normally stopping air flow between said intake and exhaust passages, actuatable by said cover to open, thereby allowing air flow between said intake and exhaust passages;

whereby, said poppet valve can be pressed by said cover to open so that compressed air can flow into said solvent pumping unit.

* * * * *